US005516374A

United States Patent [19]

Habu et al.

[11] Patent Number: 5,516,374

[45] Date of Patent: May 14, 1996

[54] METHOD OF MANUFACTURING AN ALUMINUM ALLOY SHEET FOR BODY PANEL AND THE ALLOY SHEET MANUFACTURED THEREBY

[75] Inventors: Tetsushi Habu; Minoru Hayashi; Yoichiro Bekki, all of Tokyo, Japan

[73] Assignee: The Furukawa Electric Co., Ltd., Tokyo, Japan

[21] Appl. No.: 238,253

[22] Filed: May 4, 1994

[30] Foreign Application Priority Data

Nov. 12, 1992 [JP] Japan ..... 4-327430

[51] Int. Cl.[6] ..... C22F 1/04

[52] U.S. Cl. ..... 148/552; 148/692; 148/695; 148/696; 148/439; 148/440; 420/550

[58] Field of Search ..... 148/552, 692, 148/695, 696, 439, 440; 420/533, 535, 542, 543, 544, 545, 547, 550, 551, 552, 553

[56] References Cited

U.S. PATENT DOCUMENTS 5,181,969 1/1993 Komatsubara et al. ..... 148/552

FOREIGN PATENT DOCUMENTS

0593034A2 4/1994 European Pat. Off. .
0594509A1 4/1994 European Pat. Off. .
2-118049 5/1990 Japan .
4-147936 5/1992 Japan .

OTHER PUBLICATIONS

Patent Abstracts of Japan, vol. 16, No. 431 (C–0983) 9 Sep. 1992 of JP–A–04 147 936 (Kobe Steel Ltd.) 21 May 1992.

Database WPI, Section Ch, Week 9227, Derwent Publications, Ltd., London, GB, Class M26, AN 92–223143 of JP–A–4 147 936 (Kobe Steel Ltd) 21 May 1992.

Database WPI, Section Ch, Week 9347, Derwent Publications, Ltd., London, GB, Class M26, AN 93–374932 of JP–A–5 279 821 (Furukawa Aluminum KK) 26 Oct. 1993.

Database WPI, Section Ch, Week 9405, Derwent Publications, Ltd., London, GB, Class M26, AN 94–040173 of JP–A–5 345 962 Furukawa Aluminum KK) 27 Dec. 1993.

Database WPI, Section Ch, Week 9426, Derwent Publications, Ltd., London, GB, Class M26, AN 94–211244 of JP–A–6 145 926 Furukawa Aluminum KK) 27 May 1994.

*Primary Examiner*—David A. Simmons
*Assistant Examiner*—Robert R. Koehler
*Attorney, Agent, or Firm*—Frishauf, Holtz, Goodman, Langer & Chick

[57] ABSTRACT

A method for manufacturing an aluminum alloy sheet for use in a body panel material, comprising: (a) casting a melted aluminum alloy containing Al, Mg, Fe, Mn, Cr, Ti and Zr, having a Mg content of 4 to 10 weight %, and having contents of Fe, Mn, Cr, Ti and Zr which are determined by a value f satisfying the following equation (I), and the balance being Al: 0.4 wt %≦f≦1.5 wt % (I), wherein, f=(Fe)+1.1 (Mn)+1.1 (Cr)+3 (Ti)+3 (Zr), wherein (Fe), (Mn), (Cr), (Ti), and (Zr) respectively represent the percentage content by weight of Fe, Mn, Cr, Ti and Zr, to form an ingot; (b) hot rolling the ingot to obtain a hot rolled sheet; (c) cold rolling the hot rolled sheet at a cold reduction R satisfying the following equation (II): $-\log(f-0.2)+8 \leqq R \leqq -60 \log(f-0.2)+50$ (II) to obtain a cold rolled sheet; (d) subjecting the cold rolled sheet to a final annealing treatment including raising the temperature of the rolled sheet to 450° to 550° C. at a rate of 100° C./minute or more, and maintaining the attained temperature for 300 seconds or less; and (e) cooling the annealed rolled sheet at a cooling rate of 100° C./minute or more to obtain an aluminum alloy sheet having a grain size of 20 and 80 μm.

10 Claims, 1 Drawing Sheet

METHOD OF MANUFACTURING AN ALUMINUM ALLOY SHEET FOR BODY PANEL AND THE ALLOY SHEET MANUFACTURED THEREBY

BACKGROUND OF THE INVENTION

1. Field of the Invention

The present invention relates to a method of manufacturing an aluminum alloy sheet for use in body panel material for automobiles and the like, and to the aluminum alloy sheet manufactured by this method. More particularly, the present invention is concerned with an aluminum alloy sheet capable for recycling and excellent in formability such as deep drawing and bulging.

2. Description of the Related Art

Recently, for the purpose of environmental protection and reducing fuel consumption, light-weight structural materials have been demanded. In particular, endeavors to develop light-weight automobile parts, which have been conventionally formed of mild steel sheet, have been aggressively pursued. In an attempt to employ light-weight automobile parts, an aluminum alloy sheet has started to be used for automobile parts, such as automotive wheel parts, and structural materials such as constructional materials.

The aluminum alloy sheet used as a structural material is required to be excellent in properties including strength, formability, and corrosion resistance. For this reason, an Al—Mg alloy being well-balanced in the above-mentioned properties, is generally used.

However, the conventional aluminum alloy sheet is inferior in formability due to poor ductility compared to a mild steel sheet. The poor ductility is caused by the presence of a coarse intermetallic compound in the aluminum alloy sheet. Attempts have been made to improve the ductility by increasing the purity of the alloy metal matrix or subjecting an aluminum alloy, whose Mg content has been increased, to an annealing treatment at a high temperature so as to decrease the content of the coarse intermetallic compound. It is expected that any of these attempts inevitably increase manufacturing cost, causing significant problems when the attempts are put into practice.

An aluminum material is easily recyclable as well as light-weight. However, the recycling produces contamination with impurities, namely, elements other than the alloy elements. The coarse intermetallic compound derived from the impurities present in the alloy metal matrix decreases the ductility, leading to poor formability.

With increasing the constituent particles by recycling, precipitates and recrystallization are facilitated, with the result is that the grain size decreases. When the grain size of the aluminum alloy sheet decreases, ductility and formability deteriorate. Further, with decreasing grain size, the R üders line frequently appears, affecting the appearance of the aluminum alloy sheet.

Then, in order to increase the grain size, a method is employed involving application of a cold rolling treatment to the aluminum alloy at a relatively small cold reduction to lower the driving force of the recrystallization. On the other hand, when the grain size is excessively large, ductility and formability also deteriorate, forming an orange peel on the aluminum alloy sheet. Accordingly, to realize a material excellent in ductility and formability having good appearance after sheet formation, it is necessary to select an appropriate cold reduction.

SUMMARY OF THE INVENTION

The present invention has been made based on the above mentioned circumstances. The object of the present invention is to provide an aluminum alloy sheet excellent in ductility and formability maintaining a good appearance after sheet formation.

The present inventors have found that by selecting an appropriate cold reduction in accordance with an increased amount of the impurities, the grain size can be adjusted, and sufficient ductility can be achieved, thereby improving the formability. Based on the above novel findings, the present invention has been achieved.

To be more specific, the present invention provides a method for manufacturing an aluminum alloy sheet for use in body panel materials, comprising the steps of: obtaining an ingot by casting a melted aluminum alloy whose Mg content is 4 to 10 wt %, and whose contents of Fe, Mn, Cr, Ti, and Zr are restricted to the value f satisfying the equation I set forth below, and the balance of which is Al; obtaining a rolled sheet by applying a cold rolling treatment to the ingot at a cold reduction R satisfying the following equation II, after the ingot is subjected to a hot rolling treatment; subjecting the rolled sheet to a final annealing treatment including the processes of raising the temperature to 450° to 550° C. at a rate of 100° C./min or more, and maintaining the attained temperature for 300 seconds or less; and obtaining an aluminum alloy sheet by subjecting the rolled sheet to a cooling treatment at a cooling rate of 100° C./min or more.

$$0.4 \text{ wt } \% \leqq f \leqq 1.5 \text{ wt } \% \quad \text{(I)}$$

wherein, f=[Fe]+1.1[Mn]+1.1[Cr]+3[Ti]+3[Zr], [Fe], [Mn], [Cr], [Ti], and [Zr] represent the contents of Fe, Mn, Cr, Ti, and Zr, respectively, in terms of percentages by weight.

$$-\log(f-0.2)+8 \leqq R \leqq -60 \log(f-0.2)+50 \quad \text{(II)}$$

In the above-mentioned method, to adjust the cold reduction R within the above-mentioned range, a process annealing treatment is appropriately performed in the middle course of the processing.

Further, the present invention provides an aluminum alloy sheet for use in body panel material, having a grain size of 20 to 80 μm and obtained by restricting the Mg content to 4 to 10 wt % and the contents of Fe, Mn, Cr, Ti, and Zr to the value f satisfying the following equation I, and the remainder being Al;

$$0.4 \text{ wt } \% \leqq f \leqq 1.5 \text{ wt } \% \quad \text{(I)}$$

wherein, f=[Fe]+1.1[Mn]+1.1[Cr]+3[Ti]+3[Zr], [Fe], [Mn], [Cr], [Ti], and [Zr] represent the contents of Fe, Mn, Cr, Ti, and Zr, respectively, in terms of percentages by weight.

Further, in the present invention, Cu may be added to the aluminum alloy in an amount of 0.5 wt % or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates a presently preferred embodiment of the invention and, together with the general description given above and the detailed description of the preferred embodiment given below, serves to explain the principles of the invention.

DETAILED DESCRIPTION OF THE PREFERRED EMBODIMENT

Figure 1:
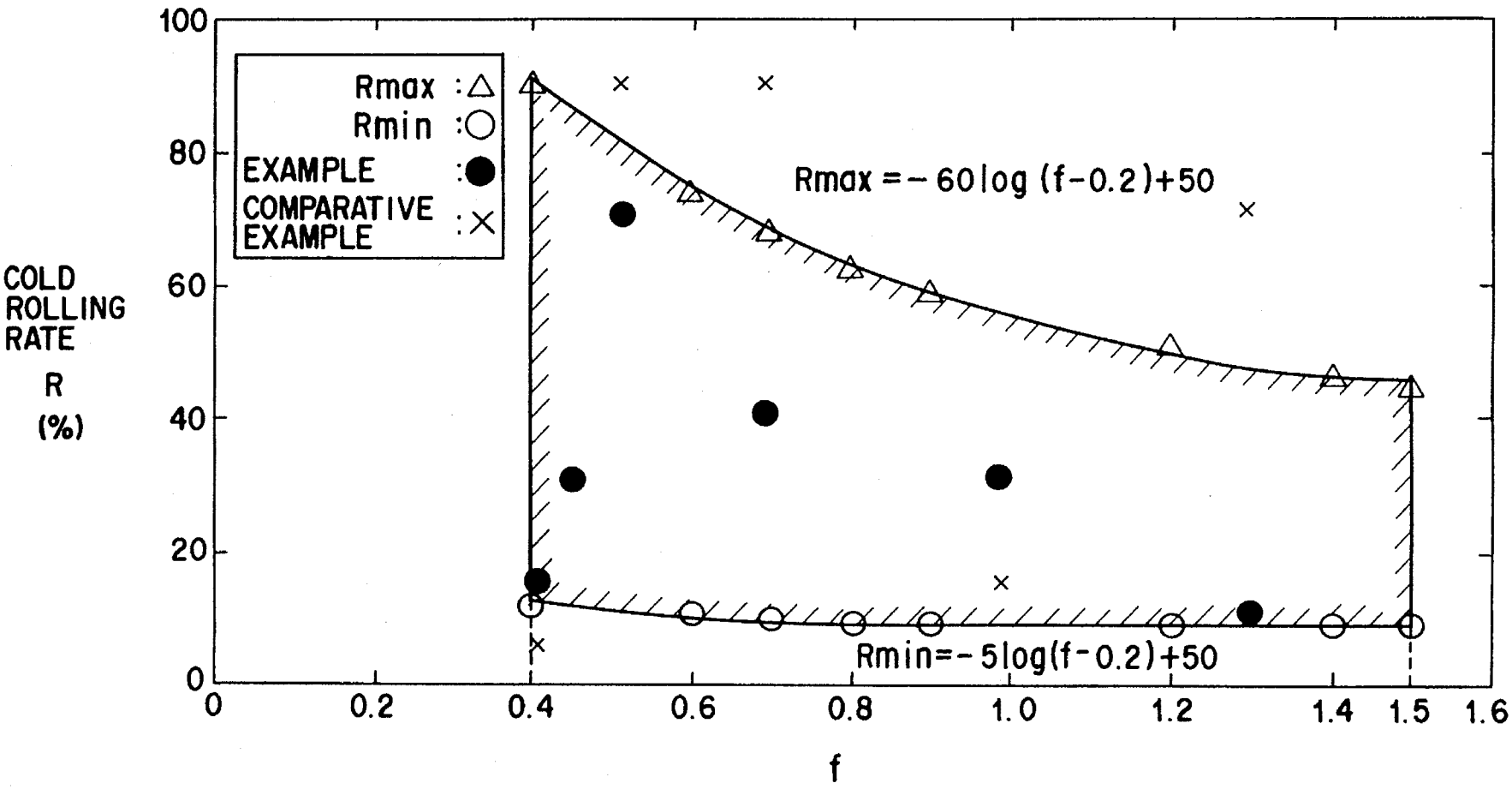
FIG. 1 is a graph showing the relationship between Fe equivalent in the aluminum alloy and the cold reduction.

Hereinafter the reasons for restricting the alloy component as described above in the present invention will be described.

Mg is an important element to increase the strength and the ductility, as well as to improve the formability of an aluminum alloy sheet. The Mg content should be restricted to 4 to 10 wt %. If the Mg content is less than 4 wt %, the formability would not be sufficiently improved, and if Mg is added in excess of 10 wt %, the improvement proportional to the content increase would not be observed. High Mg content inevitably raises the manufacturing cost. As a result, difficulties are encountered when the aluminum sheet is industrially manufactured.

Cu is an element to increase the strength and the ductility of an aluminum alloy sheet in the same way as Mg.

The Cu content should be 0.5 wt % or less. If the Cu content exceeds 0.5 wt %, the corrosion resistance and the casting ability as well as the hot rolling processability of the aluminum alloy sheet would deteriorate. As a result, it will be very difficult to produce the aluminum alloy sheet industrially.

Fe, Mn, Cr, Zr, and Ti are effective to form fine crystal grains at the time of recrystallization. However, if they are present in the aluminum alloy in a large amount, corrosion resistance, toughness, and formability would deteriorate. Hence, it is preferred that Fe be contained in an amount of 1.0 wt % or less, Mn in an amount of 1.0 wt % or less, Cr in an amount of 0.3 wt % or less, Ti in an amount of 0.2% or less, and Zr in an amount of 0.3% or less.

These five elements were specifically evaluated on their refinement using Fe as a criterion. As a result, it was found that Mn and Cr was 1.1 times more effective than Fe in the refinement, and that Ti and Zr were 3 times more effective than Fe. If the ability of Mn, Cr, Ti, and Zr to form fine-grained crystal are expressed in terms of Fe equivalent, the effect of each element may be indicated thus: 1.1[Mn], 1.1[Cr], 3[Ti], and 3[Zr]. [Mn], [Cr], [Ti], and [Zr] are the contents (wt %) of Mn, Cr, Ti, and Zr, respectively.

Therefore, the effect provided by the mixture of all elements present in the impurities on the refinement can be expressed by the total of the Fe equivalent of each elements as shown in the following:

$$f=[Fe]+1.1[Mn]+1.1[Cr]+3[Ti]+3[Zr]$$

In the present invention, f should be restricted to satisfy 0.4 wt %$\leqq f \leqq$1.5 wt %. If the f value is less than 0.4 wt %, the manufacturing cost would be high, and if the f value exceeds 1.5 wt %, corrosion resistance, toughness, and formability of the aluminum alloy sheet would deteriorate.

When the aluminum alloy is recycled, the Si contamination level does not change as much as Fe. Hence, we will not refer to Si herein, but the Si content should be suppressed to an amount of 0.5 wt % or less from the formability viewpoint. In the Al—Mg alloy of the present invention, B, Be and mish metal are added so as to improve the refinement, castability, and the like. As long as B, Be and mish metal are added in an amount of 0.1 wt % or less, 0.2 wt % or less, and 0.2 wt % or less, respectively, the effect of the present invention would not be prevented.

Hereinbelow, the manufacturing steps will be described.

In the aluminum alloy sheet of the present invention, the formability does not deteriorate even if amounts of the elements of impurities increase as long as the grain size is within the range 20 to 80 μm. If the grain size is less than 20 μm, the ductility and the formability of the aluminum alloy sheet would deteriorate and Rüuders line would be generated. On the other hand, if the grain size is in excess of 80 μm, the formability would also deteriorate, forming an orange peel on the aluminum alloy sheet.

In order to obtain the above-mentioned aluminum alloy sheet, the following steps are required.

The cold reduction R (%) in the cold rolling treatment performed after subjecting an ingot satisfying the above-mentioned equation I to the hot rolling treatment should be within the range defined by the following equation II.

$$-\log(f-0.2)+8 \leqq R \leqq -60\log(f-0.2)+50 \quad \text{(II)}$$

When the cold reduction R is less than a minimum value defined by equation II, the recrystallization of the aluminum alloy becomes slow, thereby growing the coarse crystal grain and increasing the grain size beyond 80 μm. On the other hand, when the cold reduction R exceeds a maximum value defined by equation II, the recrystallization of the aluminum alloy is facilitated. As a result, the grain size reduces excessively to less than 20 μm which is not desirable. Then, in order to adjust the cold reduction R within the above-mentioned range, a process annealing treatment is performed in the middle course of the processing.

In the final annealing treatment, the aluminum alloy is heated up at a rate of 100° C./min or more to 450° to 550° C., and is kept at the attained temperature for 300 seconds or less. If the annealing temperature is less than 450° C., recrystallization proceeds preferentially in a specific orientation, with the result that the obtained crystal is undesirably high in regards to the degree of anisotrophy. On the other hand, if the annealing temperature exceeds 550° C., the coarse recrystallized grain grows undesirably.

In the final annealing treatment, the heating rate should be set to 100° C./min or more. If the heating rate is less than 100° C., the recrystallization proceeds preferentially in a specific orientation, with the result that the obtained crystal undesirably high in regards to the degree of anisotrophy.

In the final annealing treatment, the aluminum alloy should be kept at the attained temperature in the tempering treatment for 300 sec. or less. If the annealing time exceeds 300 sec., the coarse grain would be readily generated.

In the final annealing treatment, the cooling rate should be set to 100° C./min or more. If the cooling rate is less than 100° C., a Rüders line would be readily generated.

Hereinbelow, the present invention will be described in detail.

Various types of aluminum alloys having compositions indicated in Table 1 were subjected to cast by the direct chill casting process to form ingots having a thickness of 100 mm, a width of 300 mm, and a height of 250 mm. The ingot, after both sides entire surface thereof was facing-worked in a depth of each of 10 mm, was subjected to the hot rolling treatment to form hot rolled sheets of 5 mm in thickness. Then, a final cold rolling was applied to the hot rolled sheet at a cold reduction indicated in Table 2. Thereafter, the cold rolled sheet was subjected to a final annealing treatment under a condition shown in the following Table 2 so as to form aluminum alloy sheets of 1 mm in thickness. To some of the hot rolled sheets, the process annealing treatment was appropriately applied at 360° C. for 2 hours in the middle of the cold rolling process. In Table 2, the range of an adaptable cold reduction used in the final cold rolling treatment is shown. The range was calculated from the composition shown in Table 1.

The grain size of aluminum alloy sheets was measured by means of an intercept method. Then, tension test pieces defined by the Japanese Industrial Standard (JIS) No. 5 were prepared from the aluminum alloy sheets. The tension test was performed at a tensile rate of 10 mm/min. As a result, ultimate tensile strength, yield tensile strength, and elongation were determined, and finally the ductility was evaluated.

Further, the formability was evaluated by testing stretch forming and draw forming. The results are shown in Table 3. Stretch forming test was performed by measuring the height of stretch forming by use of a punch having a spherical head of 50 mmϕ. As the height of stretch forming is desirably 18 mm or more. Draw forming test was performed by measuring the depth of the draw forming by use of a punch having a circular head of 50 mmϕ at a draw ratio of 2.2. The depth of draw forming is desirably 13 mm or more. Stretch forming test and draw forming test were performed under a lubricating condition using an anti-corrosive oil having a viscosity of 5 cSt. The change in appearance depending on the grain size was evaluated by observing the appearance after the aluminum alloy sheet was formed. The results of the change in appearance are shown in Table 3.

As is apparent from Table 3, in examples of the present invention, the aluminum alloy sheet whose the grain size has the diameter range of 20 to 80 μm exhibits satisfactory results in the ductility, the formability, and the appearance after sheet formation (see FIG. 1). In contrast, in comparative examples, any of aluminum alloy sheets whose the grain size has a diameter out of the range of 20 to 80 μm do not exhibit satisfactory ductility, formability, and appearance after sheet formation.

From the foregoing, according to the method for manufacturing the aluminum alloy sheet of the present invention, the aluminum alloy sheet satisfying all properties including ductility, formability, and the appearance after the sheet formation can be efficiently obtained as long as the manufacturing is performed within the range of the present invention even if impurities are increased by recycling.

Furthermore, according to the present invention, even if impurities is increased by recycling as long as the final cold reduction is appropriately selected, the aluminum alloy sheet for use in a body panel material excellent in the appearance after sheet formation can be obtained. Therefore, the present invention provides industrially prominent effect.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

TABLE 1

| Alloy | Composition element | | | | | | | | | |
|---|---|---|---|---|---|---|---|---|---|---|
| Symbol | Mg | Cu | Fe | Mn | Cr | Ti | Zr | Si | Al | f |
| A | 4.45 | 0.01 | 0.22 | 0.12 | 0.04 | — | 0.04 | 0.05 | balance | 0.52 |
| B | 5.25 | 0.24 | 0.52 | 0.02 | 0.06 | 0.03 | — | 0.05 | " | 0.70 |
| C | 5.32 | 0.13 | 0.61 | 0.21 | — | — | — | 0.05 | " | 0.99 |
| D | 4.72 | 0.02 | 0.98 | 0.02 | — | 0.04 | 0.06 | 0.05 | " | 1.30 |
| E | 5.90 | 0.25 | 0.16 | 0.15 | 0.04 | 0.03 | — | 0.07 | " | 0.46 |
| F | 7.81 | 0.03 | 0.09 | 0.21 | 0.03 | 0.02 | — | 0.04 | " | 0.41 |

TABLE 2

| | | | | Final cold rolling process | | Final annealing treatment condition | | | |
|---|---|---|---|---|---|---|---|---|---|
| | No. | Alloy symbol | Process annealing treatment | Adaptation range | Cold reduction | Annealing Temp. | Heating rate | Keeping time | Cooling rate |
| Example | 1 | A | not performed | 10–80% | 70% | 540° C. | 540° C./min | 30 sec | 600° C./min |
| " | 2 | B | performed | 9–68% | 40% | 540° C. | 540° C./min | 30 sec | 600° C./min |
| " | 3 | C | performed | 9–56% | 30% | 500° C. | 250° C./min | 30 sec | 300° C./min |
| " | 4 | D | performed | 8–48% | 10% | 540° C. | 250° C./min | 30 sec | 300° C./min |
| " | 5 | E | performed | 11–85% | 30% | 450° C. | 250° C./min | 60 sec | 300° C./min |
| " | 6 | F | performed | 11–91% | 15% | 500° C. | 250° C./min | 60 sec | 600° C./min |
| Comparative example | 7 | A | not performed | 10–80% | 90% | 350° C. | 40° C./min | 2 hr | 50° C./min |
| Comparative example | 8 | B | not performed | 9–68% | 90% | 500° C. | 250° C./min | 60 sec | 300° C./min |
| Comparative | 9 | C | performed | 9–56% | 15% | 570° C. | 540° C./min | 30 sec | 600° C./min |

TABLE 2-continued

| | No. | Alloy symbol | Process annealing treatment | Final cold rolling process: Adaptation range | Final cold rolling process: Cold reduction | Final annealing treatment condition: Annealing Temp. | Final annealing treatment condition: Heating rate | Final annealing treatment condition: Keeping time | Final annealing treatment condition: Cooling rate |
|---|---|---|---|---|---|---|---|---|---|
| example | | | | | | | | | |
| Comparative example | 10 | D | not performed | 8–48% | 70% | 520° C. | 150° C./min | 120 sec | 200° C./min |
| Comparative example | 11 | E | performed | 11–85% | 7% | 540° C. | 540° C./min | 500 sec | 600° C./min |
| Comparative example | 12 | F | performed | 11–91% | 5% | 450° C. | 200° C./min | 60 sec | 300° C./min |

TABLE 3

| | No. | Grain size μm | Ultimate tensile strength MPa | Yield tensile strength MPa | Elongation % | Stretch forming height mm | Draw forming depth mm | Appearance after sheet formation | Total Evaluation |
|---|---|---|---|---|---|---|---|---|---|
| Example | 1 | 30 | 263 | 116 | 30.6 | 20.1 | 12.8 | good | ○ |
| " | 2 | 55 | 289 | 131 | 29.5 | 20.1 | 13.6 | " | ◎ |
| " | 3 | 40 | 287 | 137 | 29.7 | 19.6 | 13.3 | " | ○ |
| " | 4 | 35 | 291 | 129 | 29.6 | 20.1 | 13.6 | " | ◎ |
| " | 5 | 60 | 324 | 153 | 32.5 | 21.1 | 13.9 | " | ◎ |
| " | 6 | 35 | 359 | 176 | 36.3 | 21.6 | 14.2 | " | ◎ |
| Comparative Example | 7 | 16 | 244 | 107 | 27.8 | 17.3 | 9.7 | Rüders line | x |
| Comparative Example | 8 | 16 | 246 | 112 | 26.4 | 14.2 | 9.7 | " | x |
| Comparative Example | 9 | 90 | 256 | 123 | 26.3 | 15.6 | 10.5 | Orange peel | x |
| Comparative Example | 10 | 15 | 279 | 119 | 25.2 | 17.5 | 11.6 | Rüders line | x |
| Comparative Example | 11 | 90 | 305 | 138 | 30.5 | 19.8 | 12.9 | Orange peel | x |
| Comparative Example | 12 | 130 | 331 | 152 | 32.4 | 19.8 | 13.2 | " | x |

What is claimed is:

1. A method for manufacturing an aluminum alloy sheet for use in a body panel material, comprising the steps of:

(a) casting a melted aluminum alloy comprising Al, Mg, Fe, Mn, Cr, Ti and Zr, having a Mg content of 4 to 10% by weight, and having contents of Fe, Mn, Cr, Ti and Zr which are determined by a value f satisfying the following equation (I), and the balance of the aluminum alloy being Al, $$0.4 \text{ wt } \% \leqq f \leqq 1.5 \text{ wt } \% \quad \text{(I)}$$

wherein f=(Fe)+1.1 (Mn)+1.1 (Cr)+3 (Ti)+3 (Zr), wherein (Fe), (Mn), (Cr), (Ti), and (Zr) respectively represent the percentage content by weight of Fe, Mn, Cr, Ti and Zr, to form an ingot, wherein Fe is in an amount of 0.22 to 1.0 wt. %, Mn is in an amount of 1.0 wt. % or less, Cr is in an amount of 0.3 wt. % or less, Ti is in an amount of 0.2 wt. % or less, and Zr is in an amount of 0.3 wt. % or less;

(b) hot rolling the ingot to obtain a hot rolled sheet;

(c) cold rolling the hot rolled sheet at a cold reduction percent (R) satisfying the following equation (II), to obtain a cold rolled sheet:

$$-\log(f-0.2)+8 \leqq R \leqq -60 \log(f-0.2)+50 \quad \text{(II)};$$

(d) subjecting the cold rolled sheet to a final annealing treatment including raising the temperature of said rolled sheet to attain a temperature of 450° to 550° C. at a rate of 100° C./minute or more, and maintaining the attained temperature for 300 seconds or less; and (e) cooling the annealed rolled sheet at a cooling rate of 100° C./minute or more to obtain an aluminum alloy sheet having a grain size of 20 to 80 μm.

2. The method according to claim 1, wherein the rolled sheet after said hot rolling treatment is subjected to a process annealing treatment in the middle of the cold rolling process.

3. The method according to claim 1, wherein said aluminum alloy contains further Cu in an amount of 0.5 wt % or less.

4. The method according to claim 1, wherein said aluminum alloy further contains Si in an amount of 0.5 wt % or less.

5. The method according to claim 1, wherein the aluminum alloy further contains one or more of 0.1 wt. % or less B, 0.2 wt. % or less Be and 0.2 wt. % or less mish metal.

6. The method according to claim 3, wherein the aluminum alloy further contains 0.5 wt. % or less of Si.

7. The method according to claim 6, wherein the aluminum alloy contains 4.45 weight % Mg, 0.01 weight % Cu, 0.22 weight % Fe, 0.12 weight % Mn, 0.04 weight % Cr, 0.04 weight % Zr, 0.05 weight % Si, and the balance being Al.

8. The method according to claim 6, wherein the aluminum alloy contains 5.25 weight % Mg, 0.24 weight % Cu, 0.52 weight % Fe, 0.02 weight % Mn, 0.06 weight % Cr, 0.03 weight % Ti, 0.05 weight % Si, and the balance being Al.

9. The method according to claim 6, wherein the aluminum alloy contains 5.32 weight % Mg, 0.13 weight % Cu, 0.61 weight % Fe, 0.21 weight % Mn, 0.05 weight % Si, and the balance being Al.

10. The method according to claim 6, wherein the aluminum alloy contains 4.72 weight % Mg, 0.02 weight % Cu, 0.98 weight % Fe, 0.02 weight % Mn, 0.04 weight % Ti, 0.06 weight % Zr, 0.05 weight % Si, and the balance being Al.

* * * * *